United States Patent [19]

Graham et al.

[11] 4,259,170

[45] Mar. 31, 1981

[54] PROCESS FOR MANUFACTURING LUBE BASE STOCKS

[75] Inventors: Ronald I. Graham, Yardley, Pa.; Edwin A. Hicks, Cherry Hill, N.J.

[73] Assignee: Mobil Oil Corporation, Fairfax, Va.

[21] Appl. No.: 75,558

[22] Filed: Sep. 14, 1979

[51] Int. Cl.[3] ..... C10G 55/00; C10G 71/00

[52] U.S. Cl. ..... 208/33; 208/18; 208/92; 208/111

[58] Field of Search ..... 208/18, 33, 111, 92

[56] References Cited

U.S. PATENT DOCUMENTS

| | | | |
|---|---|---|---|
| 3,658,689 | 4/1972 | Steimetz et al. | 208/18 |
| 3,902,988 | 9/1975 | Bennett et al. | 208/18 |
| 3,956,102 | 5/1976 | Chen et al. | 208/111 |
| 3,989,616 | 11/1976 | Pagen et al. | 208/18 |

*Primary Examiner*—Herbert Levine

*Attorney, Agent, or Firm*—C. A. Huggett; V. J. Frilette

[57] ABSTRACT

This invention provides an improved method for manufacturing a slate of lubricant base stocks from a paraffin base or a mixed base crude. In one embodiment of this invention, the bright stock raffinate is catalytically dewaxed with a catalyst comprising ZSM-5, for example, and the neutral oil raffinates are solvent dewaxed. The combined use of solvent and catalytic dewaxing as described herein provides a highly efficient method of manufacture without loss of product quality.

12 Claims, 2 Drawing Figures

PROCESS FOR MANUFACTURING LUBE BASE STOCKS

BACKGROUND OF THE INVENTION

1. Field of the Invention

This invention is concerned with the manufacture of high quality lubricating oils, and in particular with lubricating oils derived from petroleum. It is especially directed to the preparation of low pour point lubricating oils from crude oils of high wax content.

2. Prior Art

Refining suitable petroleum crude oils to obtain a variety of lubricating oils which function effectively in diverse environments has become a highly developed and complex art. Although the broad principles involved in refining are qualitatively understood, there are quantitative uncertainties which require considerable resort to empiricism in practical refining. Underlying these quantitative uncertainties is the complexity of the molecular constitution of lubricating oils. Because lubricating oils for the most part are based on petroleum fractions boiling about above 550° F., the molecular weight of the hydrocarbon constituents is high and these constituents display almost all conceivable structures and structure types. This complexity and its consequences are referred to in "Petroleum Refinery Engineering," by W. L. Nelson, McGraw Hill Book Company, Inc., New York, N.Y., 1958 (Fourth Edition), relevant portions of this text being incorporated herein by reference for background.

The basic notion in lubricant refining is that a suitable crude oil, as shown by experience or by assay, contains a quantity of lubricant base stock having a predetermined set of properties such as, for example, appropriate viscosity, oxidation stability, and maintenance of fluidity at low temperatures. The process of refining to isolate that lubricant base stock currently consists of a set of subtractive unit operations which removes the unwanted components. The most important of these unit operations include distillation, solvent refining, and dewaxing, which basically are physical separation processes in the sense that if all the separated fractions were recombined one would reconstitute the crude oil.

A lubricant base stock (i.e. a refined oil) may be used as such as a lubricant, or it may be blended with another lubricant base stock having somewhat different properties. Or, the base stock, prior to use as a lubricant, may be compounded with one or more additives which function, for example, as antioxidants, extreme pressure additives, and V.I. improvers. As used herein, the term "stock," regardless whether or not the term is further qualified, will refer only to a hydrocarbon oil without additives. The term "raw stock" will be used herein to refer to an untreated viscous distillate or the residuum fraction of crude petroleum oil isolated by vacuum distillation of a reduced crude from atmospheric distillation, or its equivalent. The term "solvent-refined stock" or "raffinate" will refer to an oil that has been solvent extracted, for example with furfural. The term "dewaxed stock" will refer to an oil which has been treated by any method to remove or otherwise convert the wax contained therein and thereby reduce its pour point. The term "waxy," as used herein, will refer to an oil of sufficient wax content to result in a pour point greater than +25° F. The term "stock", when unqualified, will be used herein generically to refer to the viscous fraction in any stage of refining, but in all cases free of additives. The term "base stock" will refer to an oil refined to a point suitable for some particular end use, such as for preparing automotive oils.

Briefly, for the preparation of high grade lubricating oil base stocks, the current practice is to vacuum distill an atmospheric tower residuum from an appropriate crude oil as the first step. This step provides one or more raw stocks within the boiling range of about 550° to 1050° F. and a vacuum residuum. After preparation, each raw stock is extracted with a solvent, e.g. furfural, phenol or chlorex, which is selective for aromatic hydrocarbons, and which removes undesirable components. The vacuum residuum usually requires an additional step to remove asphaltic material prior to solvent extraction. The raffinate from solvent refining is then dewaxed by admixing with a solvent such as a blend of methyl ethyl ketone and toluene, for example. The mixture is chilled to induce crystallization of the waxes which are then separated from the dewaxed dissolved raffinate in quantity sufficient to provide the desired pour point for the subsequently recovered dewaxed raffinate.

In general, refineries do not manufacture a single lube base stock but rather process at least one distillate fraction and the vacuum residuum. For example, three distillate fractions differing in boiling range and the residuum may be refined. These four fractions have acquired various names in the refining art, the most volatile distillate fraction often being referred to as the "light neutral" fraction or oil. The other distillates are called "intermediate neutral" and "heavy neutral" oils. The vacuum residuum, after deasphalting, solvent extraction and dewaxing, is commonly referred to as "bright stock." Thus, the manufacture of lubricant base stocks involves a process for producing a slate of base stocks, which slate includes at least one refined distillate and one bright stock. The term "product slate," whenever it is herein used, is to be understood to include a bright stock. A typical product slate may have about 15% to 30% bright stock.

Viscosity Index (V.I.) is a quality parameter of considerable importance for lubricating oils to be used in automotive engines and aircraft engines which are subject to wide variations in temperature. This Index is a series of numbers ranging from 0 to 100 which indicate the rate of change of viscosity with temperature. A viscosity index of 100 indicates an oil that does not tend to become viscous at low temperature or become thin at high temperatures. Measurement of the Saybolt Universal Viscosity of an oil at 100° and 210° F., and referral to correlations, provides a measure of the V.I. of the oil. For purposes of the present invention, whenever V.I. is referred to it is meant the V.I. as noted in the Viscosity Index tabulations of the ASTM (D567), published by ASTM, 1916 Race St., Philadelphia 3, Pa., or equivalent.

To prepare high V.I. automotive and aircraft oils the refiner usually selects a crude oil relatively rich in paraffinic hydrocarbons, such oils being referred to commonly as "paraffin base" or "mixed base" crudes, since experience has shown that crudes poor in paraffins, such as those commonly termed "naphthene-base" crudes, yield little or no refined stock having a V.I. above about 40. (See Nelson, supra, pages 80–81 for classifications of crude oils). Suitable stocks for high V.I. oils, however, also contain substantial quantities of waxes which result in solvent-refined lubricating oil stocks of high pour point, i.e. a pour point greater than +25° F. Thus, in general, the refining of crude oil to prepare acceptable base stocks ordinarily includes dewaxing to reduce the pour point to not greater than +25° F. The refiner, in this step, often produces saleable paraffin wax by-product, thus in part defraying the high cost of the dewaxing step.

Raw distillate lubricating oil stocks usually do not have a particularly high V.I. However, solvent-refining, as with furfural, for example, in addition to removing unstable and sludge-forming components from the crude distillate, also removes components which adversely affect the V.I. Thus, a solvent-refined stock prior to dewaxing usually has a V.I. well in excess of specifications. Dewaxing, on the other hand, removes paraffins which have a V.I. of about 200, and thus reduces the V.I. of the waxy stock.

In recent years catalytic techniques have become available for dewaxing of petroleum stocks. A process of that nature developed by British Petroleum is described in The Oil and Gas Journal dated Jan. 6, 1975, at pages 69–73. See also U.S. Pat. No. 3,668,113.

In U.S. Pat. No. Re. 28,398 to Chen et al is described a process for catalytic dewaxing with a catalyst comprising zeolite ZSM-5. Such processes combined with catalytic hydrofinishing is described in U.S. Pat. No. 3,894,938. In U.S. Pat. No. 3,755,138 to Chen et al is described a process for mild solvent dewaxing to remove high quality wax from a lube stock, which is then catalytically dewaxed to specification pour point. The entire contents of these patents are herein incorporated by reference.

A process for the manufacture of lube base stock oils of low pour point and excellent stability by catalytic dewaxing at specified conditions with a zeolite catalyst such as ZSM-5 is described in U.S. patent application Ser. No. 862,460 filed Dec. 20, 1977, the entire contents of which are incorporated herein by reference.

It is interesting to note that catalytic dewaxing, unlike prior-art dewaxing processes, although subtractive, is not a physical process but rather depends on transforming the straight chain and other waxy paraffins to non-wax materials. Thus, at least some loss of potentially saleable wax is inherent.

It is an object of this invention to provide an improved process for preparing lubricant base stocks from a waxy or a mixed base crude. It is a further object to provide a process for manufacturing a slate of lube base stocks from waxy raw lubricant stocks in increased yield. It is a further object of this invention to utilize, in prescribed fashion, both solvent dewaxing and catalytic dewaxing unit processes to provide, more economically than heretofore, lubricant base stocks from paraffin base or intermediate base crudes. These and other objects will become apparent to those skilled in the art on reading this entire specification including the appended claims.

BRIEF DESCRIPTION OF THE INVENTION

It has now been found that the process of manufacturing low pour point lube base stocks from a paraffin base or a mixed base crude is improved by catalytically dewaxing at least the bright stock raffinate and solvent dewaxing at least one distillate stock, as more fully described hereinbelow. When the catalytic and solvent dewaxing unit processes are used in combination and as prescribed herein, the yield of specification pour point bright stock is increased and the throughput capacity of the solvent dewaxing unit for the neutral oils is increased by substantially more than the throughput passed to the catalytic dewaxing unit.

DETAILED DESCRIPTION AND PREFERRED EMBODIMENTS

Figure 1:
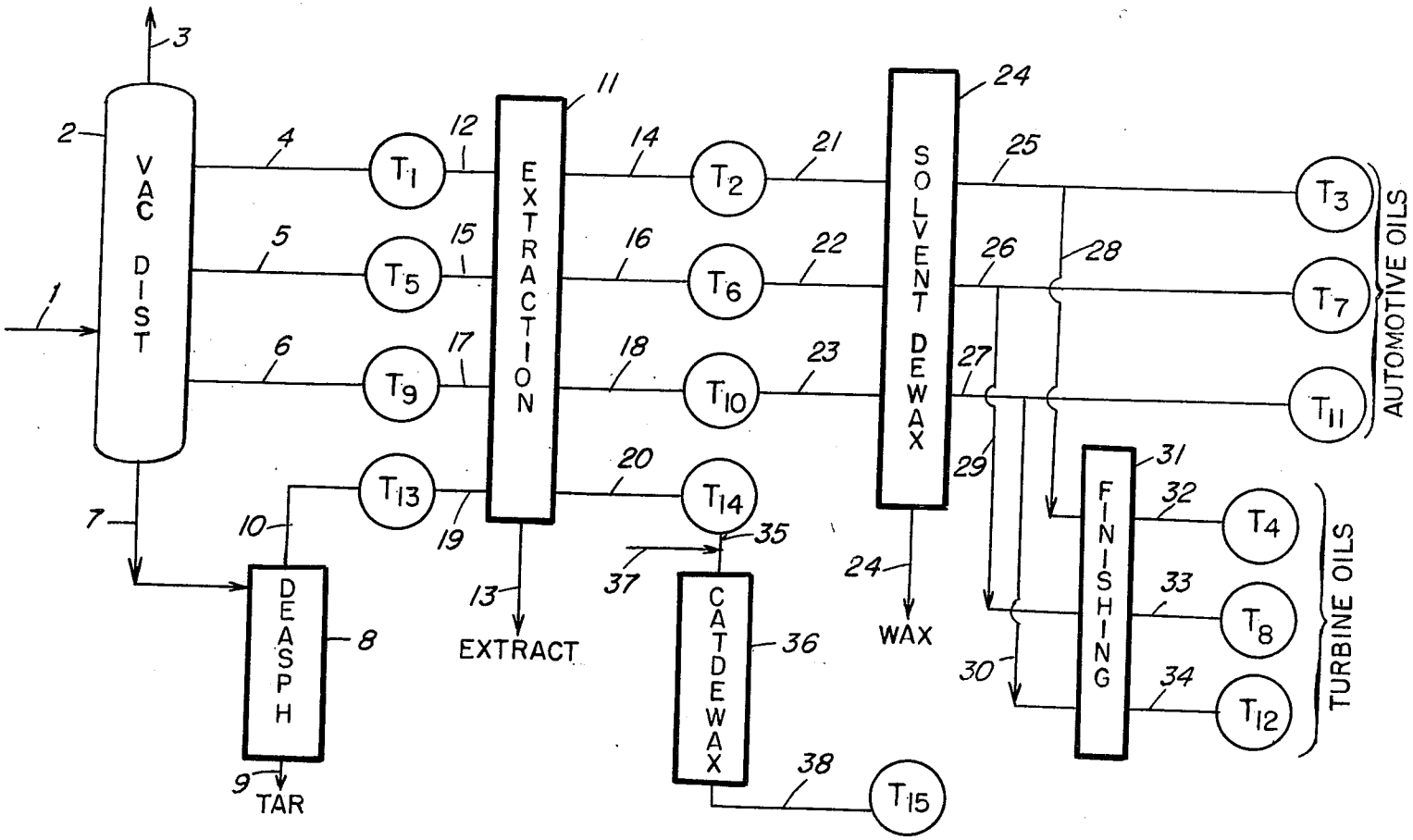
FIG. 1 A refinery configuration according to this invention

The process of this invention will now be described by reference to FIG. 1 of the drawing. A suitable reduced crude prepared by atmospheric pressure distillation of a paraffin base or intermediate base crude oil is passed via line 1 to vacuum distillation tower 2. Light ends are removed from the system via line 3. A light distillate fraction, which is a raw lubricant stock, sometimes referred to as light neutral oil, is passed from tower 2 via line 4 to storage tank $T_1$. Similarly, an intermediate neutral oil is passed via line 5 to storage tank $T_5$, and a heavy neutral oil is passed via line 6 to intermediate storage tank $T_9$. The undistilled material, known as vacuum residuum, is passed via line 7 to a deasphalting section 8, where it is treated by any of a number of processes, such as propane deasphalting, to separate out the tar which is removed via line 9. The deasphalted oil is passed via line 10 to intermediate storage tank $T_{13}$. At a suitable point in time, the light neutral oil in storage tank $T_1$ is passed to an extraction section 11 via line 12 where it is treated with any one of a number of suitable solvents to remove undesirable constituents by preferential solution. The extract is removed from the system via line 13 and the light neutral oil raffinate is passed via line 14 to intermediate storage tank $T_2$. In the extraction section 11, any suitable selective solvent may be used, such as furfural, phenol, chlorex, nitrobenzene, n-methyl-pyrrolidone, or other. At an appropriate point in time, the flow via line 12 is interrupted and the intermediate neutral oil in storage tank $T_5$ is passed via line 15 to the extraction section 11, the extract again rejected via line 13, and the intermediate neutral oil raffinate passed via line 16 to storage tank $T_6$. Similarly, the heavy neutral oil in storage tank $T_9$ is passed via line 17 to section 11 and the heavy neutral raffinate is passed via line 18 to storage tank $T_{10}$. The deasphalted residuum in storage tank $T_{13}$, again at an appropriate point in time, is passed via line 19 to extraction section 11 and thence via line 20 to storage tank $T_{14}$.

It will be recognized by those skilled in the art that the process stages described above are conventional. The illustration chosen shows the preparation of four segregated streams, but of course fewer or more distillate fractions may be prepared. With certain highly paraffinic raffinates, which are substantially free of asphalt, treatment in the deasphalting section 8 may be omitted. In other cases, section 8 may provide a combined deasphalting and solvent extraction process. These and other variants are contemplated as within the scope of the present invention, the variations not being of material significance since they are not at the point of novelty of the present invention. It will be further recognized by those skilled in the art that the process being described is a blocked-out operation, but that variants thereof which would provide continuous flow of a raw light neutral oil, for example, via line 4 to a dedicated extraction unit (not shown) and thence via line 14 to storage tank $T_2$, are contemplated as within the scope of the present invention.

The waxy raffinates in storage tank $T_2$, $T_6$, and $T_{10}$ are individually and separately passed, at their respective appropriate points in time, via lines 21, 22, and 23 to solvent dewaxing section 24, where they are mixed with a solvent such as MEK-toluene, for example, chilled to the appropriate temperature to crystallize the wax and separated therefrom. The wax is removed and recovered via line 24, and the dewaxed light, intermediate, and heavy stocks are passed via line 25, 26, and 27 to storage tanks $T_3$, $T_7$ and $T_{11}$. The material in the last three storage tanks are lube base stocks suitable for use in blending automotive oils. A portion of each of the dewaxed raffinates may be diverted via lines 28, 29 and 30, respectively, to a finishing section 31 wherein they are further refined and passed via lines 32, 33 and 34, respectively, to storage tanks $T_4$, $T_8$ and $T_{12}$, respectively. The oils in the last three mentioned tanks are lube oil base stocks suitable for compounding as turbine oils or for other lubricants and specialty oils. The processes utilized in finishing section 31 may include any known process such as clay percolation and catalytic hydrofinishing. For purposes of the present invention, it is preferred that the unit process in finishing section 31 be catalytic hydrofinishing, which utilizes a catalyst such as cobalt moly on alumina and wherein the oil is catalytically contacted in the presence of hydrogen under relatively mild conditions to reduce the color and the sulfur and nitrogen content of the oil in order to improve its stability in use.

It is an essential step in the process of the present invention to catalytically dewax the waxy bright stock raffinate passed from line 20 to tank $T_{14}$. In fact, tank $T_{14}$ in FIG. 1 is optional. The waxy bright stock is passed either to tank $T_{14}$ and then via line 35, preferably together with hydrogen supplied via line 37, to the catalytic dewaxing section 36, or it may be passed directly from line 20 into line 35, thus by-passing tank $T_{14}$, and then into the catalytic dewaxing section 36. Dewaxed bright stock is passed from section 36 line 38 to tank $T_{15}$. This stock is useful for blending automotive oils, or for other uses, depending on the particular treatment given in the catalytic dewaxing section, as more fully described hereinbelow.

The catalytic dewaxing section 36 comprises a catalytic dewaxing reactor wherein the bright stock raffinate is dewaxed to the desired pour point. Usually this operation creates some undesirable light hydrocarbons which preferably are removed by flashing. Also, to impart good stability properties to the bright stock, it is often desirable to hydroprocess it. Thus, dewaxing section 36, as illustrated in FIG. 1, is contemplated in preferred form to include a dewaxing reactor and means for hydrofinishing and removing light ends from the dewaxed bright stock.

Figure 2:
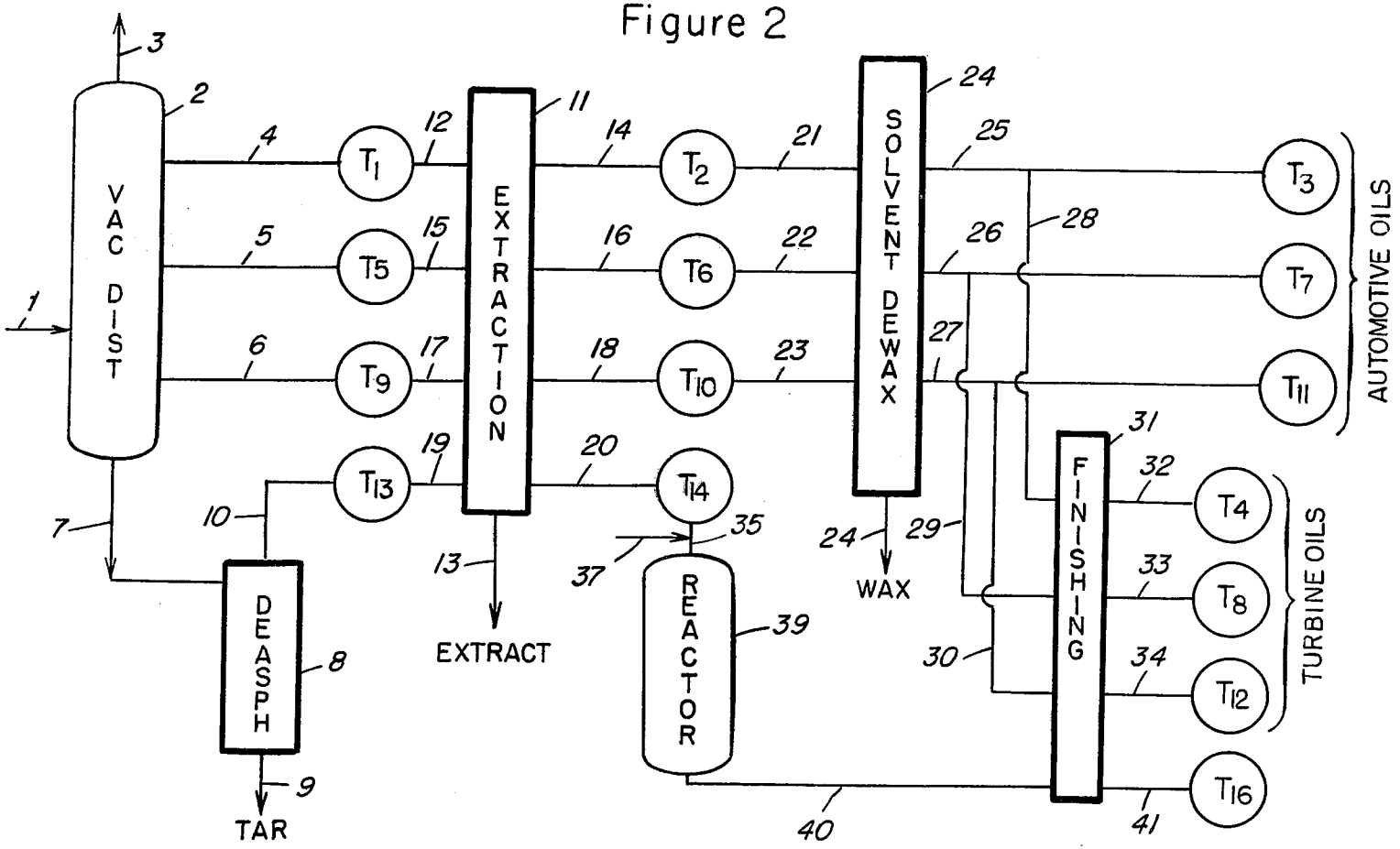
FIG. 2 A second refinery configuration according to this invention.

It is a feature of this invention that existing plants often may be modified at low cost to provide substantially increased total throughput if the plant has hydrofinishing equipment already in place. FIG. 2 of the drawing illustrates the configuration of such a modified plant. in FIG. 2, the symbols shown which appear in FIG. 1 are intended to represent the same elements or steps and their descriptions given above are incorporated here and repeated for FIG. 2. As shown in FIG. 2, the bright stock raffinate in tank $T_{14}$ is passed via line 35 together with hydrogen to catalytic dewaxing reactor 39 and thence via line 40 to finishing section 31 wherein it is hydrofinished and treated to remove light ends, after which it is passed via line 41 to storage tank $T_{16}$.

In the foregoing illustrations of the novel process of this invention, the utilization of the combination of solvent dewaxing and catalytic dewaxing is unusually effective in producing an increased yield of total product because catalytic dewaxing of waxy bright stock, as more fully described hereinbelow, may be conducted with a substantial increase in yield and with no significant penalty on specifications such as V.I., pour point, etc. A further and significant economic advantage is achieved by diverting the waxy bright stock, as taught by this invention, from the solvent dewaxing unit 24, where it has heretofore been processed, to the catalytic dewaxing section 36. This advantage accrues because the throughput capacity of dewaxing section 24 is increased by more than the volume of bright stock diverted, thus increasing the throughput capacity of the portion of the process that treats the raffinates passed from the extraction section 11. Should the refiner choose not to process all of the deasphalted residuum, it is obvious that the reduced throughput increases the neutral oil throughput capacity of extraction unit 11. The process of this invention is particularly advantageous in those instances for which excess distillation and extraction capacity is already in place, or for which an increase of such capacity is readily achievable.

Any catalytic dewaxing method that is effective to reduce the pour point of waxy bright stock with equal or preferably greater volume yield than is achieved by solvent dewaxing may be used for purposes of this invention. Effective methods in general depend on utilizing a catalyst that transforms easily solidified wax constituents to materials that solidify with difficulty, and that causes little or no other change in desirable constituents.

Preferred dewaxing catalyst compositions, for the purpose of this invention, comprise a crystalline zeolite of a novel class characterized by a constraint index of about 1 to about 12, as more fully described hereinbelow, and by a silica to alumina ratio of at least 12. The catalysts preferably are associated with a Group VIII metal hydrogenation component such as nickel or palladium, and are in the form of pellets suitable for use in a fixed bed reactor. The crystalline zeolites will now be more fully described.

The preferred crystalline zeolites are members of a novel class of zeolites that exhibit unusual properties. Although these zeolites have unusually low alumina contents, i.e. high silica to alumina ratios, they are very active even when the silica to alumina ratio exceeds 30. The activity is surprising since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning with oxygen-containing gas such as air.

An important characteristic of the crystal structure of this class of zeolites is that it provides constrained access to and egress from the intracrystalline free space by virtue of having an effective pore size intermediate between the small pore Linde A and the large pore Linde X, i.e. the pore windows of the structure have about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful in this invention have an effective pore size such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although in some instances excessive puckering of the rings or pore blockage may render these zeolites ineffective. 12-membered rings usually do not offer sufficient constraint to produce the advantageous conversions, although the puckered 12-ring structure of TMA offretite shows constrained access. Other 12-ring structures may exist which, due to pore blockage or to other cause, may be operative.

Rather than attempt to judge from crystal structure whether or not a zeolite possesses the necessary constrained access to molecules larger than normal paraffins, a simple determination of the "Constraint Index" as herein defined may be made by passing continuously a mixture of an equal weight of normal hexane and 3-methylpentane over a small sample, approximately one gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature is adjusted between 550° F. and 950° F. to give an overall conversion between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}\ (\text{fraction of n-hexane remaining})}{\log_{10}\ (\text{fraction of 3-methylpentane remaining})}$$

The Constraint Index approximates the ratio of the cracking rate constants for the two hydrocarbons. Zeolites suitable for the present invention are those having a Constraint Index of 1 to 12. Constraint Index (CI) values for some typical zeolites are:

| CAS | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| TMA Offretite | 3.7 |
| Beta | 0.6 |
| H-Zeolon (mordenite) | 0.4 |
| REY | 0.4 |
| Amorphous Silica-Alumina | 0.6 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby have different Constraint Indexes. Constraint Index seems to vary somewhat with severity of operation (conversion) and the presence or absence of binders. Therefore, it will be appreciated that it may be possible to so select test conditions to establish more than one value in the range of 1 to 12 for the Constraint Index of a particular zeolite. Such a zeolite exhibits the constrained access as herein defined and is to be regarded as having a Constraint Index of 1 to 12. Also contemplated herein as having a Constraint Index of 1 to 12 and therefore within the scope of the novel class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value of 1 to 12. Thus, it should be understood that the Constraint Index value as used herein is an inclusive rather than an exclusive value. That is, a zeolite when tested by any combination of conditions within the testing definition set forth hereinabove to have a Constraint Index of 1 to 12 is intended to be included in the instant catalyst definition regardless that the same identical zeolite tested under other defined conditions may give a Constraint Index value outside of 1 to 12.

The class of zeolites defined herein is exemplified by ZSM-5, ZSM-11, ZSM-12, ZSM-23, ZSM-35, ZSM-38, and other similar materials. U.S. Pat. No. 3,702,886 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particulary described in U.S. Pat. No. 4,046,859, the entire content of which is incorporated herein by reference.

The specific zeolites described, when prepared in the presence of organic cations, are substantially catalytically inactive, possibly because the intracrystalline free space is occupied by organic cations from the forming solution. They may be activated by heating in an inert atmosphere at 1000° F. for one hour, for example, followed by base exchange with ammonium salts followed by calcination at 1000° F. in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 1000° F. for from about 15 minutes to about 24 hours.

Natural zeolites may sometimes be converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminsolicates are ZSM-5, ZSM-11, ZSM-12, ZSM-23, ZSM-35, and ZSM-38, with ZSM-5 being particularly preferred.

In a preferred aspect of this invention, the zeolites hereof are selected as those having a crystal framework density, in the dry hydrogen form, of not less than about 1.6 gram per cubic centimeter. It has been found that zeolites which satisfy all three of these criteria are most desired for several reasons. When hydrocarbon products or by-products are catalytically formed, for example, such zeolites tend to maximize the production of gasoline boiling range hydrocarbon products. Therefore, the preferred zeolites of this invention are those having a Constraint Index as defined above of about 1 to about 12, a silica to alumina ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on Page 19 of the article on Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space. It is possible that the unusual sustained activity and stability of this class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

In practicing the desired conversion process, it may be desirable to incorporate the above-described crystalline aluminosilicate zeolite in another material resistant to the temperature and other conditions employed in the process. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaoline commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix on an anhydrous basis may vary widely with the zeolite content ranging from between about 1 to about 99 percent by weight and more usually in the range of about 5 to about 80 percent by weight of the dry composite.

For purpose of the present invention the waxy bright stock raffinate passed via line 35 together with hydrogen via line 37 is contacted with the dewaxing catalyst in section 36 or reactor 39 under dewaxing conditions which include a temperature of about 400° to 850° F., a liquid hourly space velocity (LHSV) of 0.1 to 5.0 volumes of charge oil per volume of catalyst per hour, at a hydrogen partial pressure of 150–1500 psia, at the reactor inlets, and with a hydrogen circulation rate of about 500 to 5000 standard cubic feet of hydrogen per barrel of feed (SCF/B). The foregoing reaction conditions are broadly described, it being understood that the selection of particular values within the disclosed ranges will depend on the exact nature of waxy bright stock and the properties desired in the dewaxed bright stock.

A full description of a catalytic dewaxing method which utilizes the preferred catalyst hereinabove described is given in U.S. patent application Ser. No. 862,460 filed Dec. 20, 1977 now U.S. Pat. No. 4,181,598, the entire content of which is incorporated herein by reference. The dewaxing process and the conditions disclosed therein, both in broad and preferred form, are herein incorporated by reference.

The catalytic dewaxing step described above produces olefins which would impair properties of the dewaxed oil product if retained. These preferably are saturated by hydrogenation in the hydrotreater. The saturation reaction is evidenced by the temperature rise in the first portion of the hydrotreater, and confirmable by chemical analysis of the feed and hydrotreated product. By this means it is possible to prepare stable good quality lube base stock oils having pour points even below −65° F.

Whereas in the preferred embodiments of this invention, as shown in the drawing, only the bright stock raffinate is catalytically dewaxed, it will be obvious to one skilled in the art that advantages will accrue if fthe heavy neutral raffinate in tank $T_{10}$ or the intermediate neutral raffinate in tank $T_6$ also is catalytically dewaxed. Or, both the foregoing neutral raffinates and the bright stock raffinate all may be catalytically dewaxed. Though these variants of the invention are less preferred, they are contemplated as within the scope thereof.

What is claimed is:

1. In a process for manufacturing low pour point lubricant base stocks from vacuum distillation fractions of a reduced paraffin base crude or of a reduced mixed base crude, said fractions comprising a distillate fraction and a deasphalted vacuum residuum, which process comprises dewaxing said fractions thereby reducing the pour point thereof, the improvement, whereby more efficiently producing said base stocks, which comprises dewaxing said deasphalted vacuum residuum to a predetermined pour point by contact under dewaxing conditions with a dewaxing catalyst, said catalyst and conditions being effective to produce a yield of dewaxed residuum not less than is produced by solvent dewaxing said residuum to the same pour point, and solvent dewaxing said distillate fraction.

2. The process described in claim 1 wherein said catalytic dewaxing is conducted by contacting said deasphalted vacuum residuum fraction and hydrogen with a dewaxing catalyst comprising a crystalline zeolite having a silica to alumina ratio of at least about 12 and a constraint index of 1.0 to to 12.0.

3. The process described in claim 2 wherein said dewaxing catalyst comprises ZSM-5.

4. The process described in claim 2 or in claim 3 wherein said improvement comprises catalytically dewaxing only said deasphalted vacuum residuum.

5. The process described in claim 2 or in claim 3 wherein said improvement comprises catalytically dewaxing said deasphalted vacuum residuum and one or more of the higher boiling distillate fractions.

6. A process for manufacturing a slate of lubricant base stocks from an atmospheric residuum of a paraffin base crude or of a mixed base crude, which comprises:

vacuum distilling said crude and recovering a plurality of fractions of increasing boiling range, said fractions including at least one distillate fraction and a deasphalted vacuum residuum;

solvent extracting separately each of said fractions and recovering the corresponding waxy raffinates, including a neutral raffinate and a bright stock raffinate;

solvent dewaxing at least the lowest boiling waxy raffinate and recovering a dewaxed neutral stock; and catalytically dewaxing at least the waxy bright stock raffinate by contacting said raffinate and hydrogen, at a hydrogen partial pressure of 150 psia to 1500 psia, at a temperature of 400° to 850° F. and at a L.H.S.V. of about 0.1 to about 5.0, with a dewaxing catalyst comprising a crystalline zeolite having a constraint index of about 1 to about 12 and a silica to alumina ratio of at least about 12.

7. The process described in claim 6 wherein said crystalline zeolite is selected from the group consisting of ZSM-5, ZSM-11, ZSM-12, ZSM-23, ZSM-35 and ZSM-38.

8. The process described in claim 7 wherein said crystalline zeolite is associated with a hydrogen component.

9. The process described in claim 6 wherein only said bright stock raffinate is catalytically dewaxed.

10. The process described in claim 7 wherein only said bright stock raffinate is catalytically dewaxed.

11. The process described in claim 8 wherein only said bright stock raffinate is catalytically dewaxed.

12. The process described in claim 7 or claim 8 or claim 9 wherein said crystalline zeolite is ZSM-5.

* * * * *